US006994447B1

(12) United States Patent
Benensohn

(10) Patent No.: US 6,994,447 B1
(45) Date of Patent: Feb. 7, 2006

(54) SELECTIVELY SPACED MOUNTING FOR UNDER-CABINET LIGHTING FIXTURE TO ACCOMMODATE A RANGE OF CABINET WALL THICKNESS

(75) Inventor: Sanford H. Benensohn, Beverly Hills, CA (US)

(73) Assignee: Lusa Lighting International, Inc., Valencia, CA (US)

( * ) Notice: Subject to any disclaimer, the term of this patent is extended or adjusted under 35 U.S.C. 154(b) by 47 days.

(21) Appl. No.: 10/635,320

(22) Filed: Aug. 6, 2003

(51) Int. Cl.
*F21V 21/00* (2006.01)

(52) U.S. Cl. ..... 362/133; 362/368; 362/457

(58) Field of Classification Search ..... 362/33, 362/127, 133, 368, 457, 147, 432; 312/223.5
See application file for complete search history.

(56) References Cited

U.S. PATENT DOCUMENTS

| | | | | | |
|---|---|---|---|---|---|
| 1,478,870 | A | * | 12/1923 | Drees | 362/404 |
| 1,483,252 | A | * | 2/1924 | Symmes | 362/404 |
| 1,693,396 | A | * | 11/1928 | Littleton | 362/430 |
| 1,762,995 | A | * | 6/1930 | Knight | 362/457 |
| 2,567,291 | A | * | 9/1951 | Lundquist | 362/371 |
| 4,141,061 | A | * | 2/1979 | Ford et al. | 362/216 |
| 4,896,145 | A | * | 1/1990 | Lewkowicz | 362/253 |
| 5,426,572 | A | * | 6/1995 | Weinstock et al. | 362/133 |
| 5,909,955 | A | | 6/1999 | Roorda | 362/368 |
| 6,050,708 | A | | 4/2000 | Roorda | 362/375 |
| 6,431,722 | B1 | | 8/2002 | Benensohn | 362/133 |
| 6,491,413 | B1 | | 12/2002 | Benesohn | 362/294 |
| 2004/0017681 | A1 | * | 1/2004 | Lee | 362/133 |

OTHER PUBLICATIONS

U.S. Appl. No. 10/640,292, filed Aug. 13, 2003, Benensohn.
Evolution Minilites Collection Brochure, 1900 N. Andrews Ave., Ext., Suite C, Ponpano Beach FL 33069 (undated).
Outwater Hardware Catalog pp. 154, Outwater Hardware Corporation, 11 West End Road, Totowa, NJ 07512 (1998).
Laura & Honnelore Co., Ltd; GES Lighting Review Catalog, Oct. 1998.
Home Lighting and Accessories, Disc Light, Apr. 1996, p. 133.
Lighting Concepts, Outwater Plastic Industries, Inc., 4 Passaic Street, PO Drawer 403, Wood-Ridge, NJ 07075 (undated).
Lusa Lighting Inc., Product Card, 20W Combilight, 1994.

* cited by examiner

*Primary Examiner*—Alan Cariaso
(74) *Attorney, Agent, or Firm*—Baker, Donelson, Bearman, Caldwell & Berkowitz

(57) ABSTRACT

An under-cabinet lighting fixture for permanent mounting having a housing suitable for recess or surface mounting and connected by a stem to a junction box mounted to an upper opposing surface for electrical wiring connections. The stem defines a distal threaded end that receives a fastener within the junction box and provides selective positioning of the fixture to accommodate a range of thickness of the shelf to which the fixture mounts. Further, the stems defines a passageway for the electrical wiring to route from the junction box to a lamp in the housing.

16 Claims, 3 Drawing Sheets

SELECTIVELY SPACED MOUNTING FOR UNDER-CABINET LIGHTING FIXTURE TO ACCOMMODATE A RANGE OF CABINET WALL THICKNESS

TECHNICAL FIELD

The present invention relates to under-cabinet lighting fixtures. More particularly, the present invention relates to permanently mounted under-cabinet lighting fixtures with selectively spaced mounting to accommodate a range of cabinet wall thickness.

BACKGROUND OF THE INVENTION

Lights and lighting provide useful general illumination of interior and exterior spaces in homes and buildings, as well as provide ornamental and artistic treatments for decorative purposes. These purposes include lighting functions as well as highlights for artwork, for accent and interior ornamental design functions, and other functions. Often furniture or cabinetry have lights for illuminating articles held within the furniture or cabinets. For cabinets, and in particular kitchen wall cabinets, lighting fixtures are often mounted to a lower exterior surface or are recessed relative to the surface, for providing lighting to countertop surfaces below the cabinets. In a "recess" application, a cavity within a shelf or lower wall of the cabinet receives the light fixture. The lighting fixture thereby has a reduced profile outwardly of the mounting surface.

Under-cabinet puck lights are one type of lighting fixture useful for these lighting applications. Puck-type lights have generally cylindrical disc-shaped housings. The housings contain a reflector, a lamp socket with a light emitive bulb, and a cover lens for transmitting light from the housing to the countertop surface below the cabinet. The lamp socket connects to a supply of electrical current. The lights provide pools of lights to the countertop surface, and are used typically in kitchens and display cabinetry for providing light on the working surfaces in kitchens as well as for use in highlighting articles in display cabinets.

Under-cabinet puck lights that are commercially available operate with 12 volt direct current, or more recently, as disclosed in my U.S. Pat. No. 6,491,413, operate on 120 volt (line) alternating current. Generally, the puck-type lighting fixtures are provided commercially as after-market installation devices. While the low-voltage puck-type under-cabinet lighting fixtures have been satisfactory in after-market installations, permanent mounting of puck lights and high voltage puck lights require the use of appropriate junction boxes for electrical connections of the wiring, for conduit through which the electrical wires pass between the source of the current and the light, and for satisfactory access to control switches for activating the lights for use.

My U.S. Pat. No. 6,431,722 discloses an under-cabinet lighting fixture suited particularly for permanent surface and recessed mounting to a cabinet. The lighting fixture includes a housing adapted to receive a light bulb for mounting to a cabinet surface and a junction box adapted for receiving electrical wires for connecting the light bulb in the housing to a supply of electrical current. A stem disposed within a hole in the wall of the cabinet surface to which the housing mounts, connects the housing and the junction box. The stem includes a plate intermediate the distal ends, which plate stops against the junction box and the stem further defines a passageway for the electrical wires from the junction box to the light bulb in the housing.

Under-cabinet lighting fixtures of this type readily install in permanent surface and recessed mounting configurations. Stems of a standard size are provided, such as to cabinet manufacturers for installation or permanently mounted lighting fixtures during assembly of the cabinets. However, cabinets are made by different manufacturers or are even custom-made, and wall thickness of the boards used to made the cabinets vary among manufacturers. After-market installation of the under-cabinet lighting fixture may require the use of spacers to accommodate walls of thinner thickness, while walls of greater thickness may require a special or longer stem.

Accordingly, there is a need in the art for an improved undercabinet lighting fixture to readily accommodate installation to walls having a range of thickness. It is to such that the present invention is directed.

BRIEF SUMMARY OF THE PRESENT INVENTION

The present invention provides an under-cabinet lighting fixture in which a housing receives a light bulb, for mounting to a cabinet surface. A junction box is adapted for receiving electrical wires for connecting the light in the housing to a supply of electrical current and defines a hole. A stem connects at a first end to the housing and an opposing second end defines a threaded exterior surface, which stem passes through an opening in a wall of the cabinet and a hole in the junction box. The stem defines a passageway for electrical wires from the junction box to the light bulb in the housing. A fastener threadably engages the second end of the stem within the junction box to connect the housing to the junction box.

Objects, advantages, and features of the invention will be come apparent upon a reading of the following detailed description of the present invention in conjunction with the drawings and the appended claims.

DETAILED DESCRIPTION

Figure 1:
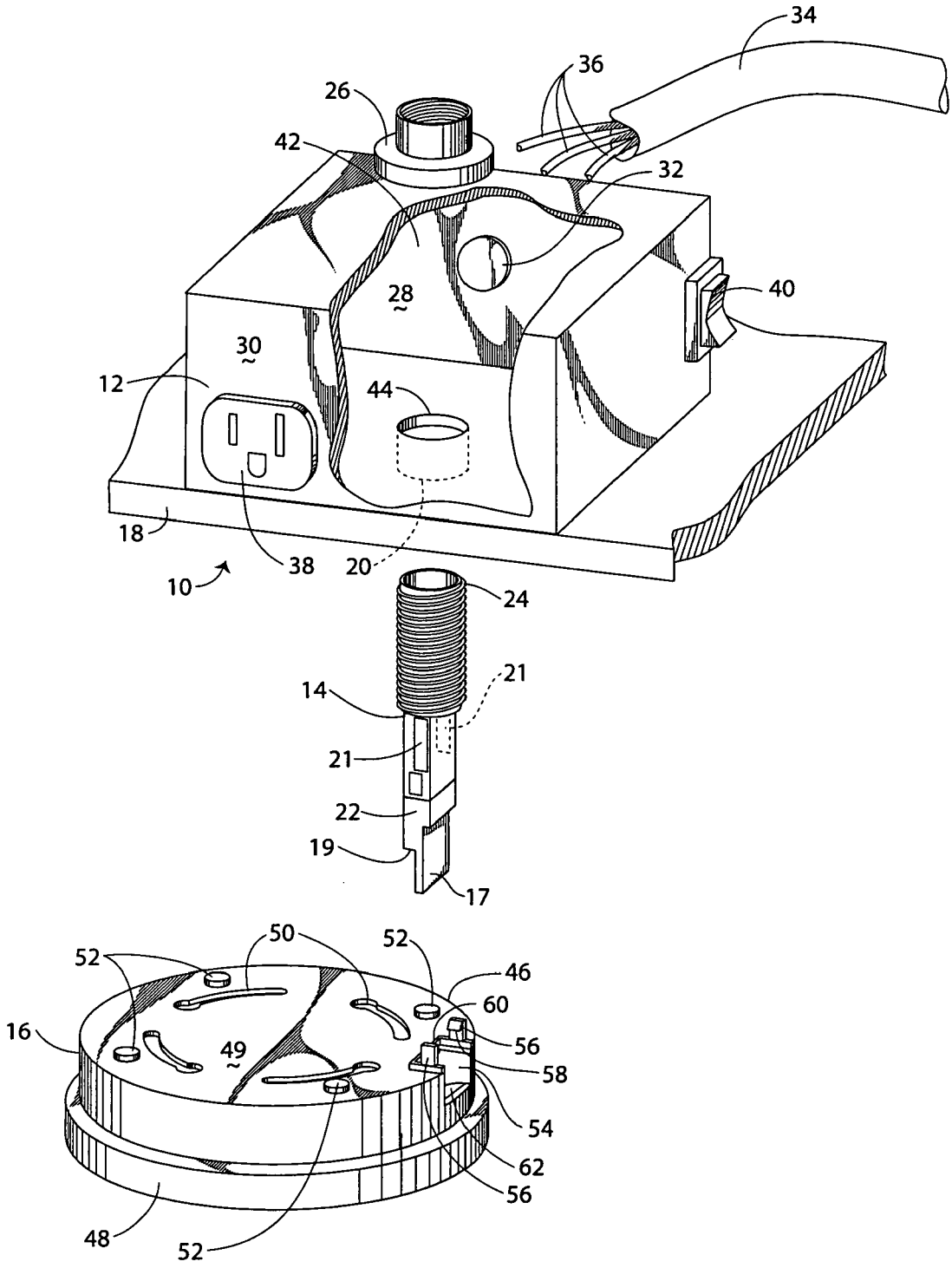
FIG. 1 is a perspective, cut-away view of a permanent under-cabinet lighting fixture according to the present invention.

Referring now in more detail to the drawings in which like parts have like identifiers, FIG. 1 illustrates in perspective cut-away view a permanent under-cabinet lighting fixture 10 according to the present invention with a junction box 12 connected by a stem 14 (exploded away) to a puck-type housing 16 for a lamp, such as the under-cabinet puck-type light fixture disclosed in my U.S. Pat. No. 6,491,413. The junction box 12 mounts to an upper surface of a mounting board or shelf 18 of a cabinet (partially illustrated). The stem 14 extends through a hole 20 in the shelf 18 and connects at a first end 22 to the lighting fixture 16. An opposing second end 24 engages a fastener 26 to connect the stem 14 to the junction box 12. The second end 24 in accordance with the present invention defines a threaded exterior at least on a portion of the stem at the second end. The stem 14 defines an open passageway between the first and second ends for receiving electrical wires from the junction box 12 to the lamp in the housing 16. The stem 14 defines an extended portion 17 offset by a step 19. A pair of recesses 21 are formed on opposing sides of the stem, for a purpose discussed below. As with conventional puck-type lighting fixtures, the permanent under-cabinet light fixture 10 in the illustrated embodiment is adapted for mounting as a surface mount (as illustrated in FIG. 1) or for recessed mounting in a shelf of a cabinet.

The electrical junction box 12 includes opposing side walls 28, 30. The side wall 28 defines a conventional knockout plate 32 shaped for receiving conventional electrical wiring conduit 34 that encloses electrical wires 36 communicating with a supply of electricity. A conduit clamp (not illustrated) conventionally connects the end of the conduit 34 to the junction box 12. A convenience outlet 38 mounts in the side wall 30 for a 120 volt line output, in an embodiment using line voltage into the electrical junction box 12. For example, a low-voltage application may have a transformer (not illustrated) mounted within the junction box 12, which transformer connects to line voltage. Also, an electrical switch 40 mounts to one end wall. The junction box 12 defines a cavity 42 for receiving the various connections of electrical wiring within the junction box. A bottom wall defines an opening 44 for receiving the second end 24 of the stem 14. The nut 26 engages the end 24 to secure the stem 14 to the junction box 12.

The housing 16 for the lighting fixture comprises a can 46 having an open end closed by a cap 48. A base 49 of the can 46 defines a partially closed bottom having a plurality of openings 50 and buttons 52 protruding from the bottom. The buttons 52 cooperatively space the can 26 from the shelf 18. The can 26 defines a socket 54 in the side wall and bottom for receiving the first end 22 of the stem 14. A pair of opposing retaining clips 56 extend from the base 49 and define portions of side walls extending from the base. Each clip 56 defines an angled projecting lip 58. A flange 60 extends from the base 49 radially interior from a side wall and extending between the clips 56. The clips 56, the flange 60, and a side portion of the can 46 cooperatively define the socket 54 for receiving the first end 22 of the stem 14. The socket 54 may be keyed, for specific alignment of the stem 14 with the socket 54. This is accomplished in the illustrated embodiment by the socket 54 defining a stepped recess 62 in a side wall of the can 16. Also, the socket 54 is keyed by the arcuate faces of the retaining clips 56. The socket 54 is open through a hole to an inner cavity of the can 46. In this way, the electrical wires from the junction box 12 pass through the stem 14 to the lamp in the housing 16.

Figure 2:
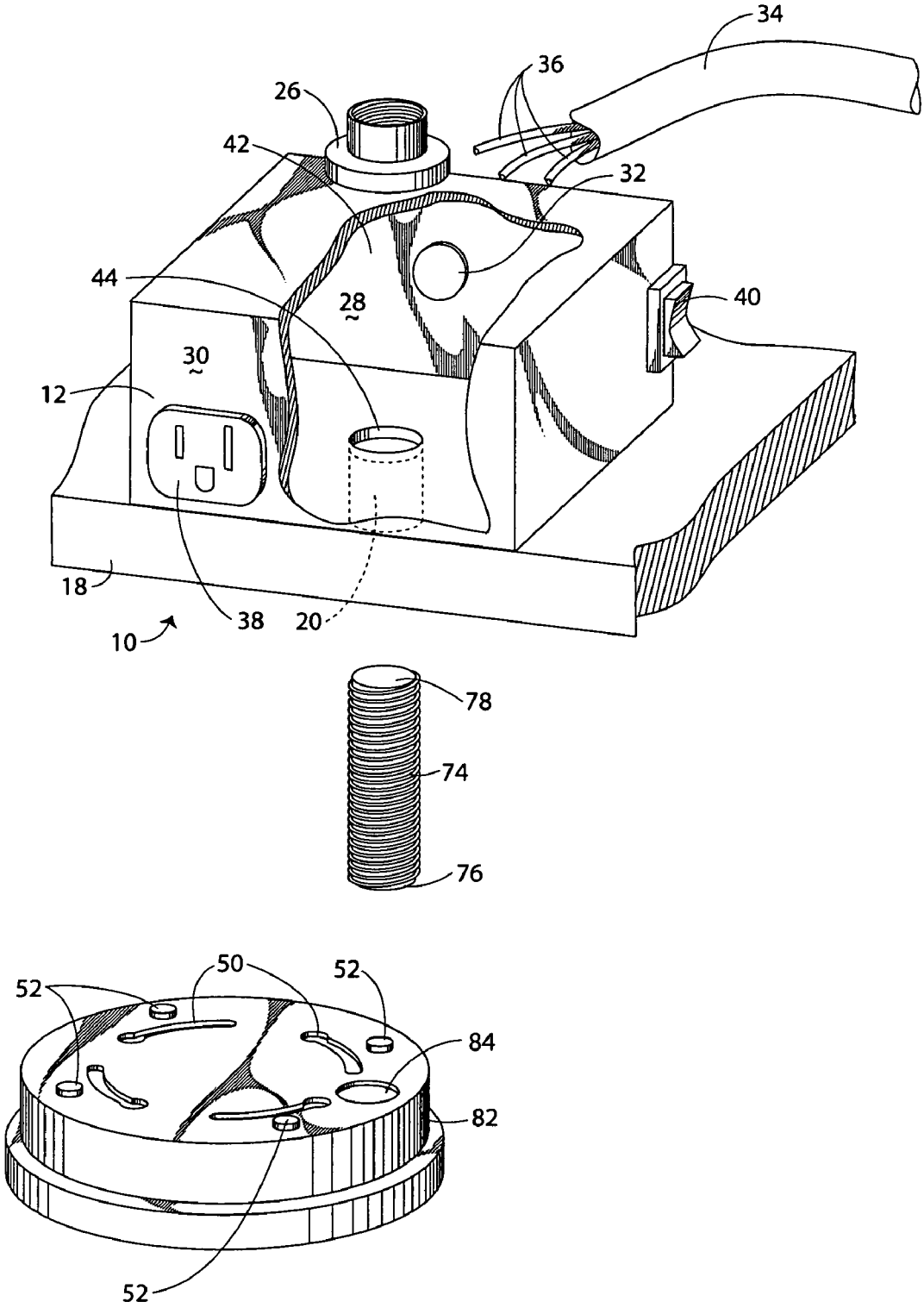
FIG. 2 is a perspective view of an alternate embodiment of the permanent under-cabinet lighting fixture according to the present invention.

FIG. 2 is a perspective view of an alternate embodiment of the permanent under-cabinet lighting fixture according to the present invention. In this embodiment, a stem 74 defines a threaded exterior between a first end 76 and an opposing second end 78. The light fixture 16 includes a can 82 similar to that of the can 46 (illustrated without a cap). However, the can 82 defines a socket 84 having a threaded inner surface. The first end 76 of the stem 74 threadably engages the socket 84, and seats a pre-determined distance within the recess. This leaves an extending portion of the stem 74 for passing through the opening 20 in the shelf 18 and into the junction box 12 through the hole 44.

Figure 3A:
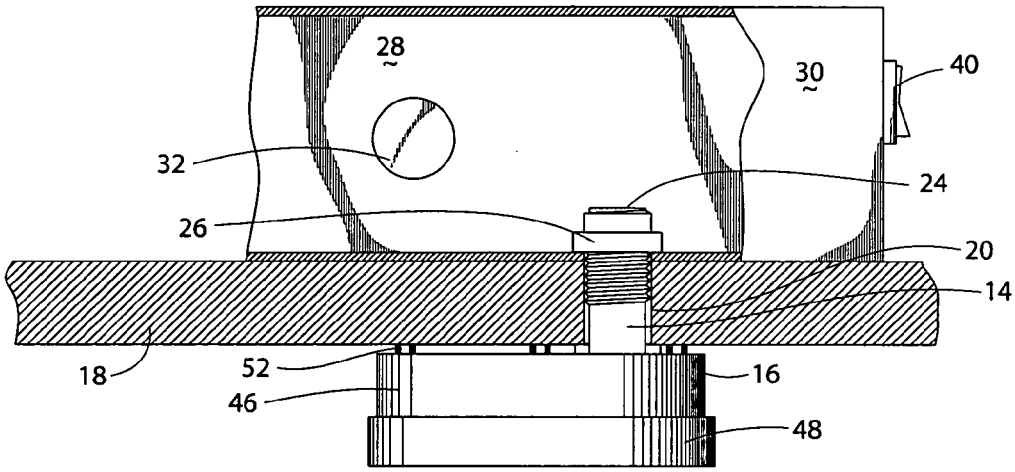
FIG. 3A is a side cut-away view of the permanent under-cabinet lighting fixture attached to a surface of a cabinet.
Figure 3B:
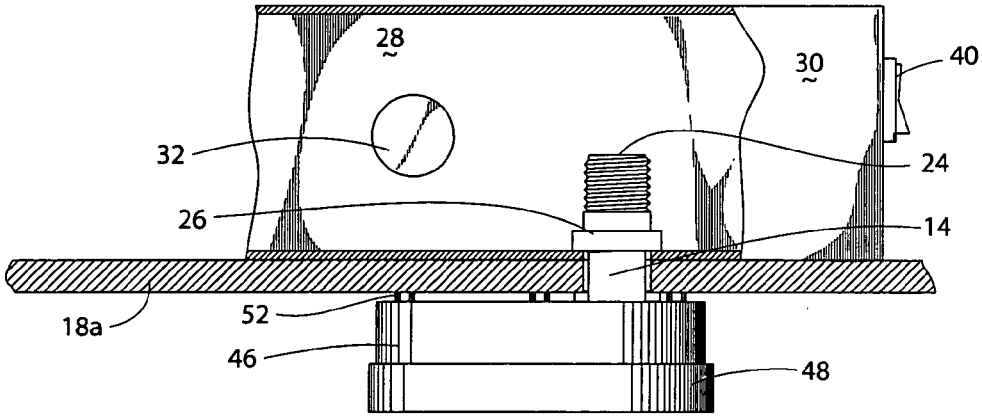
FIG. 3B is a side cut-away view of the permanent under-cabinet lighting fixture attached to a surface of a second cabinet.

FIGS. 3A and 3B are side cut-away views of the permanent under-cabinet lighting fixture 10 attached to the surface of the respective shelves 18*a* and 18*b* of a cabinet. The buttons 52 space the housing 16 from the surface of the shelf. The stem 14 connects at the lower end to the socket and extends through the opening 20 into the junction box 12 through the hole 44. The fastener 26 threads on the distal threaded end 24 of the stem 14 to attach the stem to the junction box and thus connect the junction box and the housing 16 of the lighting fixture 10. FIGS. 3A and 3B illustrate attaching the lighting fixture 10 of the present invention to shelves 18*a*, 18*b* of different thickness. The second end of the stem 14 extends partially into the cavity of the junction box. However, the length of the stem within the junction box is greater in the application illustrated in FIG. 3B than that illustrated in FIG. 3A, as the thickness of the shelf 18*a* in FIG. 3A is greater than the thickness of the shelf 18*b* in FIG. 3B. Nevertheless, the present invention provides a lighting fixture 10 readily installed in cabinetry and particularly suitable for after-market installation projects on existing cabinetry and shelving.

With reference to the FIGS. 1, 3*a*, and 3*b*, the lighting fixture 10 is used by first determining a position on the surface of the shelf 18 for the housing 16. The opening 20 is formed by drilling through the shelf 18. The junction box 12 is placed on the upper surface of the shelf 18 with the hole 44 in overlying aligned relation to the opening 20. The junction box 12 may be secured to the shelf 18 such as with screws or other fasteners.

The stem 14 connects to the housing 16. This is accomplished by inserting the first end 22 into the socket 54. The extending portion 17 passes into the recess 62 and the step 19 keys the alignment. The retaining clips 56 engage the opposing recesses 21 to lock the stem 14 to the housing 16. The assembly of the housing 16 and the stem 14 is positioned on the surface of the shelf 18 with the threaded portion 24 of the stem 14 extending through the opening 20 and through the hole 44 in the junction box 12. The fastener 26 threadingly engages the stem 44 and tightens against the bottom of the junction box to secure the junction box to the stem 14 and thus to the housing 16. Fasteners such as screws may be used to fix the housing 16 to the shelf 18.

The electrical wires 36 are routed into the junction box 12 from the conduit 34 that attaches with a conventional conduit clamp in conjunction with the opening 32. Wiring connections are made in order to communicate electrical current to the convenience outlet 38, to the lamp in the housing 16, and selectively to control either using the switch 40. Such electrical connections are conventional for one of ordinary skill in the art and no further discussion of the wiring connections is believed necessary.

While not illustrated, it is to be appreciated that the housing 16 may readily be installed in a recessed position within the shelf 18. A hole sized for receiving the housing 16 is created, such as by drilling or other cutting operation, to create the recess.

The embodiment illustrated in FIG. 2 similarly installs relative to the shelves 18*a* and 18*b*, as discussed above. The first end 76 of the threaded stem 74 engages the threaded socket 84. The stem 74 extends through the opening 20 in the shelf, with a portion extending into the cavity of the junction box 12. The fastener 26 threadingly engages the distal portion at the end 78, to secure the stem and thus the housing 16 to the junction box 12. The stem 74 (and 14) are free of stops that limit the passing of the stem through the opening 20. The stem passes through the opening 20 until the buttons 52 bear on the surface of the shelf 18, in order to accommodate a range of shelf thickness.

The present invention accordingly provides a permanently mounted under-cabinet lighting fixture suitable for either low-voltage or high-voltage (line) operations with selective spaced-apart positioning of the housing and the junction box to accommodate a range of cabinet wall thickness and particularly suited for use in after-market installation projects. The principles, preferred embodiments, and modes of operation of the present invention have been described in the foregoing specification. The invention is not to be construed as limited to the particular forms disclosed as these are regarded as illustrative rather than restrictive. Moreover, variations and changes may be made by those skilled in the are without departing from the spirit of the invention described in the following claims.

What is claimed is:

1. An under-cabinet lighting fixture, comprising:

a housing adapted to receive a light for mounting to a cabinet surface;

a junction box adapted for receiving electrical wires for placing the light in electrical communication with a supply of electrical current, and defining a hole;

a stem having a first end connected to the housing, and an opposing second end defining a threaded exterior surface thereon, the threaded exterior surface being of sufficient length to permit the stem to pass through a cabinet surface of variable width and through the hole in the junction box, and the stem defining a passageway for electrical wires from the junction box to the light in the housing; and a fastener configured to threadably engage the second end of the stem within the junction box to secure the housing relative to the junction box.

2. The under-cabinet lighting fixture as recited in claim 1, wherein the housing defines a socket for engaging the first end of the stem.

3. The under-cabinet lighting fixture as recited in claim 2, wherein the socket defines opposing retaining clips; and wherein the first end of the stem defines opposing recesses that engage the retaining clips upon insertion of the stem into the socket.

4. The under-cabinet lighting fixture as recited in claim 3, wherein the socket defines a recess; and wherein the stem defines an extended portion configured for being received in the recess, whereby the stem and socket are keyed for aligned engagement.

5. The under-cabinet lighting fixture as recited in claim 2, wherein the socket defines a threaded bore and the first end of the stem is threaded for engaging the socket.

6. The under-cabinet lighting fixture as recited in claim 1, wherein the junction box defines a knock-out plate adapted for removal for receiving a conduit from the supply of electrical current to the junction box.

7. The under-cabinet lighting fixture as recited in claim 1, further comprising an electrical switch operatively connected to the electrical wires within the junction box for selectively operating the light within the housing.

8. The under-cabinet lighting fixture as recited in claim 1, further comprising an electrical outlet for connecting to a mating electrical plug for providing electrical current to another device.

9. An under-cabinet lighting fixture, comprising:

a housing for disposing on a wall of a cabinet and enclosing a lamp, a base of the housing defining a socket;

a junction box adapted for receiving electrical wires for placing the lamp in the housing in electrical communication with a supply of electrical current, and comprising a hole in a wall thereof;

a stem for extending through an opening in the wall of the cabinet, the stem having a first end connected to the socket of the housing on a first side of the wall, and a second end defining a threaded exterior surface thereon extending through the hole in the junction box on a second opposing side of the wall, the threaded exterior surface of the stem being of sufficient length to accommodate cabinetry walls of various widths, and the stem further comprising a passageway for electrical wires from the junction box to the lamp in the housing; and a fastener sized and configured to threadably engage the second end of the stem within the junction box.

10. The under-cabinet lighting fixture as recited in claim 9, wherein the socket defines opposing retaining clips; and wherein the first end of the stem defines opposing recesses that engage the retaining clips upon insertion of the stem into the socket.

11. The under-cabinet lighting fixture as recited in claim 9, wherein the socket defines a recess; and wherein the stem defines an extended portion configured for being received in the recess, whereby the stem and socket are keyed for aligned engagement.

12. The under-cabinet lighting fixture as recited in claim 9, wherein the socket defines a threaded bore and the first end of the stem is threaded for engaging the socket.

13. The under-cabinet lighting fixture as recited in claim 9, wherein the junction box defines a knock-out plate adapted for removal for receiving a conduit from the supply of electrical current to the junction box.

14. The under-cabinet lighting fixture as recited in claim 9, further comprising an electrical switch operatively connected to the electrical wires within the junction box for selectively operating the lamp within the housing.

15. The under-cabinet lighting fixture as recited in claim 9, further comprising an electrical outlet for connecting to a mating electrical plug for providing electrical current to another device.

16. An under-cabinet lighting fixture, comprising:

a housing adapted to receive a light;

a junction box adapted for receiving electrical wires for placing the light in electrical communication with a supply of electrical current, and comprising a hole;

an elongated stem defining a passageway for receiving electrical wires from the junction box to the light in the housing, the stem having a first end configured to connect to the housing, and an opposing second end defining a threaded exterior surface thereon, the threaded exterior surface being of sufficient length to permit the stem to pass through an intermediate cabinet surface of variable width and through the hole in the junction box; and a fastener configured to threadably engage the second end of the stem within the junction box to secure the housing flush against the intermediate cabinet surface.

* * * * *